United States Patent [19]

Miyamae et al.

[11] 4,148,201

[45] Apr. 10, 1979

[54] LOCKING DEVICE

[75] Inventors: Yasuo Miyamae, Minanomachi; Masuo Miyamae, Tokyo, both of Japan

[73] Assignee: Sanpo Lock Co., Ltd., Tokyo, Japan

[21] Appl. No.: 863,050

[22] Filed: Dec. 21, 1977

Related U.S. Application Data

[63] Continuation of Ser. No. 696,514, Jun. 16, 1976, abandoned.

[51] Int. Cl.[2] ..... E05B 27/00

[52] U.S. Cl. ..... 70/358; 70/419

[58] Field of Search ..... 70/360, 358, 357, 361, 70/364 A, 364 R, 419, 421

[56] References Cited

U.S. PATENT DOCUMENTS

| | | | |
|---|---|---|---|
| 474,783 | 5/1892 | Taylor | 70/337 |
| 1,641,767 | 9/1927 | Ledin | 70/367 |
| 1,929,658 | 10/1933 | Solliday | 70/360 |
| 3,251,546 | 5/1966 | Rigo | 70/360 |
| 3,512,382 | 5/1970 | Check | 70/276 |

*Primary Examiner*—Robert L. Wolfe

*Attorney, Agent, or Firm*—Oblon, Fisher, Spivak, McClelland & Maier

[57] ABSTRACT

A locking device is disclosed which comprises a multi-leaved key which is adapted to be inserted within a correspondingly configured keyhole provided within an inner cylinder member. The inner cylinder member is slidably disposed within an outer cylinder member so as to permit or prevent rotation of the inner cylinder member with respect to the outer cylinder member through the interaction between a projection member and a slot or groove respectively provided upon the inner and outer cylinder members, as well as to permit or prevent the inner cylinder member from being engaged with a cam member which is operatively associated wih a lock bolt. In this manner, the multi-leaved key must not only be inserted within the locking device, but after insertion thereof, the key must be pushed forwardly still further in order to move the inner cylinder member relative to the outer cylinder member so as to disengage the projection member from the slot, and to engage the inner cylinder member with the cam member, whereby rotation of the inner cylinder member and operation of the locking device to an unlocked condition may be accomplished. The key may or may not be withdrawn under such unlocked conditions, as desired and determined by the lock structure.

3 Claims, 10 Drawing Figures

LOCKING DEVICE

This is a continuation of application Ser. No. 696,514, filed June 16, 1976 and now abandoned.

BACKGROUND OF THE INVENTION

1. Field of the Invention

The present invention relates generally to locking devices, and more particularly to a multi-leaved locking device which has several operative characteristics which render the same highly secure and particularly reliable as a locking device.

2. Description of the Prior Art

Conventional locking devices are operated, for locking and unlocking mechanisms, by inserting a key into a keyhole and turning the key therein. The key normally comprises a single-leaf bit, one or both sides of which are provided with recesses, however, such a locking device has a characteristically low degree of security due to the limited number of leaves and combinations of recesses thereon, and in addition, the locking mechanism is easily operated through means of a simple rotational operation.

SUMMARY OF THE INVENTION

Accordingly, it is an object of the present invention to provide a new and improved locking device.

Another object of the present invention is to provide a new and improved locking device which exhibits a high degree of security.

Still another object of the present invention is to provide a new and improved locking device which is not operable through means of a simple rotational movement of the key within the keyhole.

The foregoing and other objects of the present invention are achieved through the provision of a locking device which requires for the operation thereof that, in addition to the mere insertion of the key therewithin, the key must be pushed in the forward direction still further in order to in fact be able to rotate the key so as to engage the appropriate operative members of the device in order to actuate the locking mechanism thereof, the key also comprising a multiplicity of leaves. In this manner, a greater number of combinations of plunger or pin recesses is required with respect to the particular key which is adapted to operate the locking device, which of course increases the security of the locking device, and still further, due to the peculiar or particular mode of operation thereof, the security of the device is increased still further.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
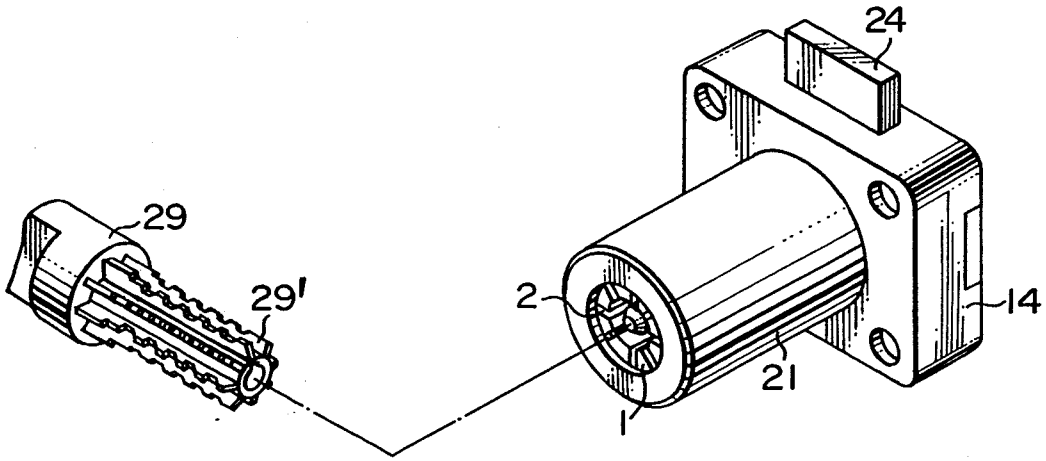
FIGS. 1–3 are exploded, perspective views of various components of one embodiment of a locking device constructed in accordance with the present invention and showing its cooperative parts.
Figure 2:
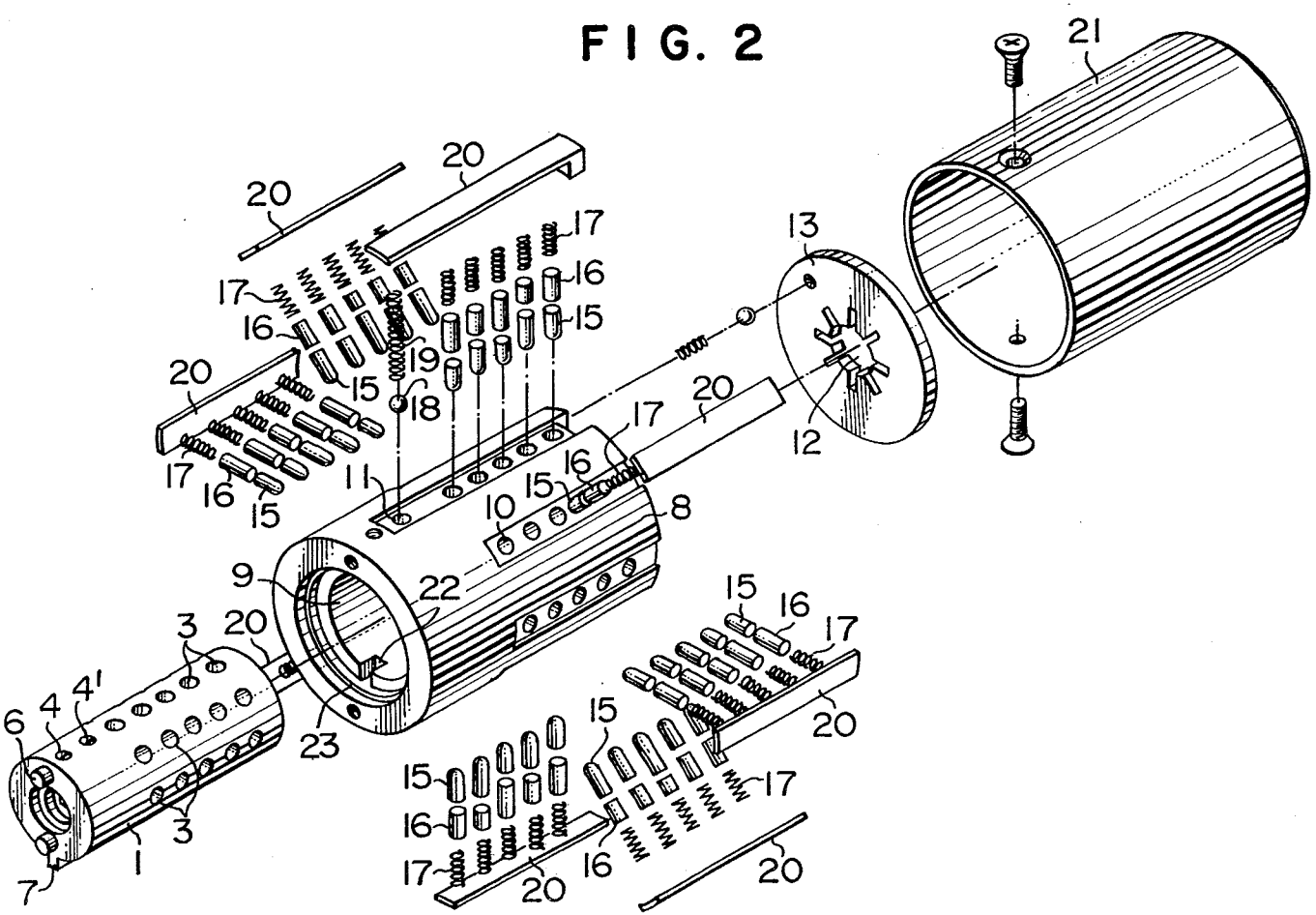
Figure 3:
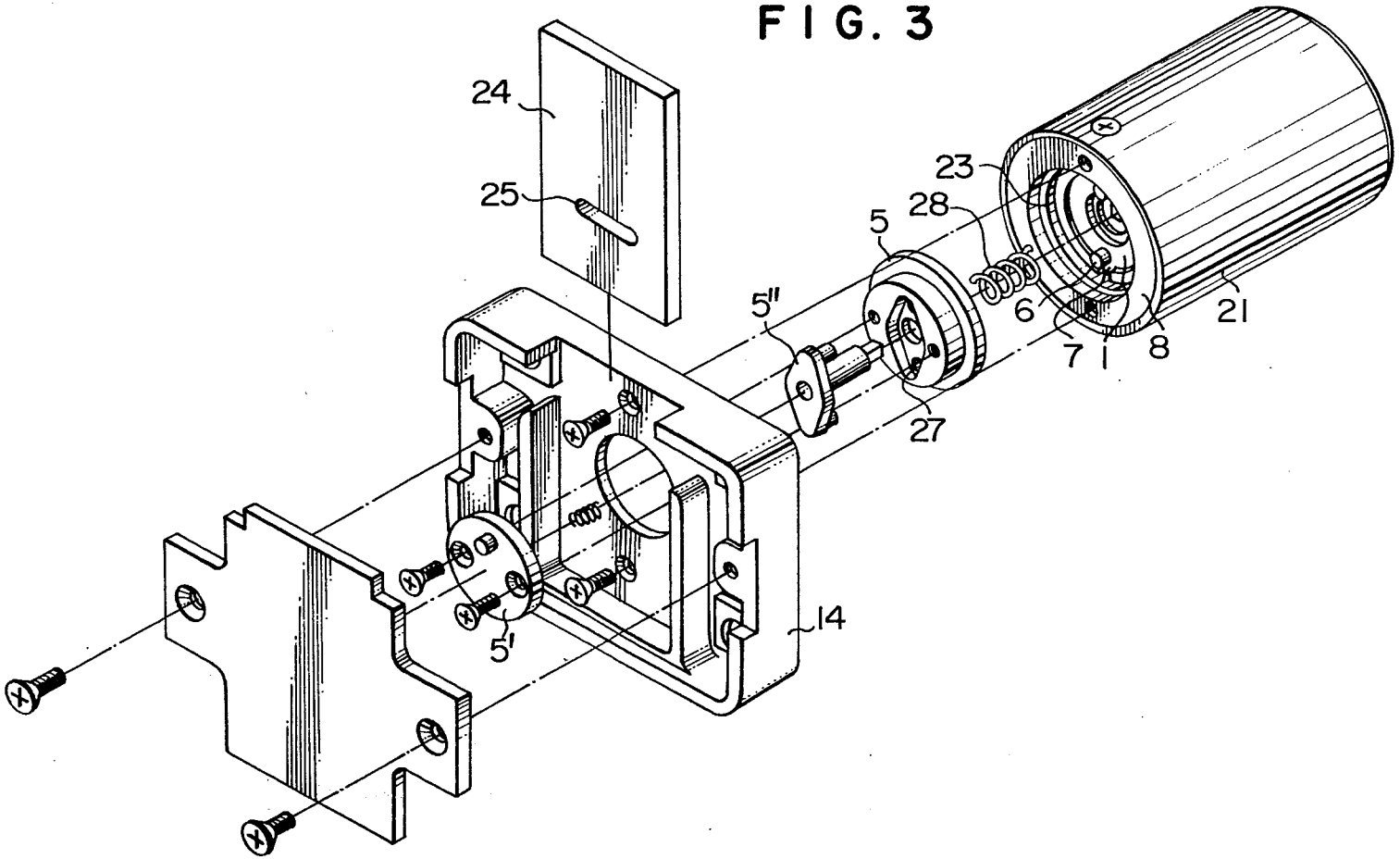

Referring now to the drawings, and more particularly to FIGS. 1–3 thereof, an inner cylinder 1 has an axially extending keyhole 2 provided therein, the keyhole 2, in turn, being provided with means defining a plurality, such as, for example, eight, of radially extending slots, not numbered. The inner cylinder 1 is also provided with a plurality of pin holes 3 which are radially disposed so as to penetrate or extend to the slots of the keyhole 2, and is additionally provided with recesses 4 and 4' at appropriate rearward positions thereof. The rear end face of the inner cylinder 1 is provided with projections 6 so as to engage with an operating cam 5, the circumferential, rear end portion of the inner cylinder 1 being provided with a radial projection 7, and the inner cylinder 1 is adapted to be fitted in an outer cylinder 8 so as to be slidably movable in a back-and-forth fashion within a through-bore 9 of outer cylinder 8.

The outer cylinder 8, having the inner cylinder 1 disposed in the bore 9, is also provided with pin holes 10, which corresponds to the pin holes 3 of the inner cylinder 1, and a hole 11, which corresponds to the recess 4 of the inner cylinder 1, the pin holes 10 and hole 11 penetrating or extending to the bore 9.

The front of the outer cylinder 8 is provided with a protective plate 13 which is provided with a key inserting hole 12 having the same shape as that of the keyhole 2, and the rear portion of the outer cylinder 8 is provided with a groove 22, within which the projection 7 may be disposed, and an annular groove 23 within which the projection 7 rotates. A locking mechanism box 14 is fixed to the rear end of the outer cylinder 8, and as noted hereinabove, the inner cylinder 1 is disposed in the bore 9 of the outer cylinder 8 such that the inner cylinder 1 may be slidably movable in a back-and-forth fashion within bore 9.

Radially inner and outer cylinder pins 15 and 16, for level coincidence, are provided in all of the pin holes 3 and 10, respectively, and springs 17 are also disposed within holes 10 for biasing the inner and outer cylinder pins 15 and 16 radially inwardly within the pin holes 3 and 10. The hole 11 is fitted with a detent ball 18 which is selectively disposable into one of the recesses 4 and 4', and a spring 19 biases ball 18 radially inwardly. The holes 10 and 11 are covered with axially extending plates 20, and a cylindrical casing 21 is disposed about the outer cylinder 8.

The operating cam 5, acting on a vertically slidable bolt 24, comprises a cam member 5" and a cam plate 5' which is provided with an axial projection 26 that fits within a guide aperture 25 of bolt 24. The operating cam 5 is also provided with openings 27 into which the projections 6 at the rear end of the inner cylinder 1 fit when the inner cylinder 1 is moved rearwardly. The operating cam 5 is rotatably fitted within the locking mechanism box 14 and the rear end of the inner cylinder 1, and a spring 28 is interposed between the operating cam 5 and inner cylinder 1 so as to insure engagement of the projections 6 with openings 27 which thereby establishes the integral connection between the operating cam 5 and the inner cylinder 1 when the inner cylinder 1 is moved rearwardly.

A key 29 is provided with the same number of leaves 29' as that of the slots defined witnin the keyhole 2 provided in the inner cylinder 1, and the leaves 29' are provided with appropriate recesses for moving the cylinder pins 15 and 16 for thereby attaining level coincidence. For operating the lock, the key leaves 29' are inserted from the key inserting hole 12 of plate 13 into the keyhole 2 for level coincidence, and the key 29 is subsequently pushed in still futher in order to move the inner cylinder 1 rearwardly.

Figure 4:
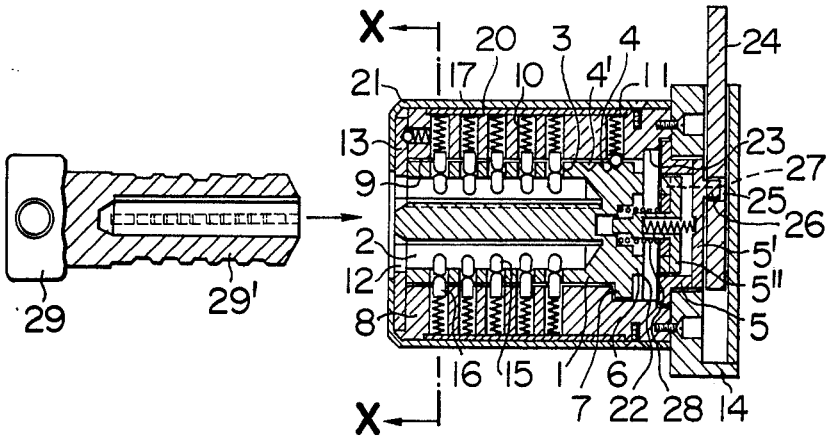
FIGS. 4–7 are axial, cross-sectional views of the embodiment of FIG. 1 showing the locking device in various operative states.
Figure 5:
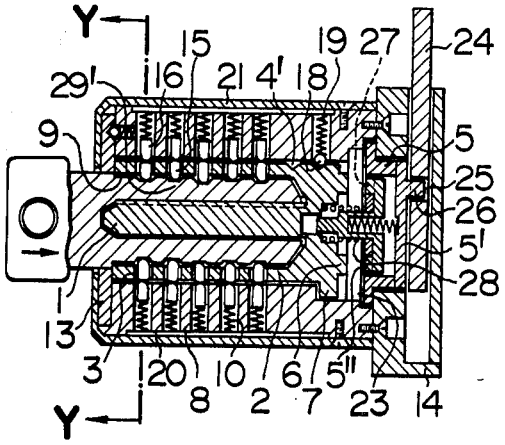
Figure 9:
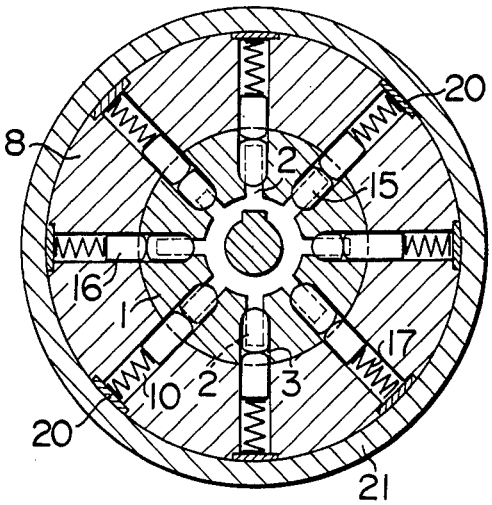
FIG. 9 is a cross-sectional view of the apparatus of FIG. 4 taken along the line X—X of FIG. 4.
Figure 10:
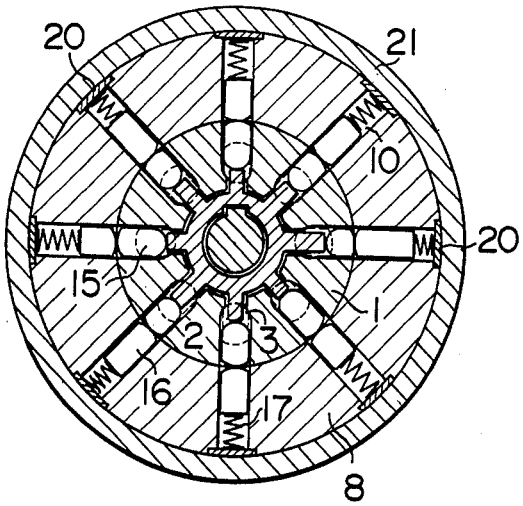
FIG. 10 is a cross-sectional view of the apparatus of FIG. 5 taken along the line Y—Y of FIG. 5.

The operation of the embodiment constructed according to the present invention and as described above, will now be explained with reference to FIGS. 4–7. Referring first to FIGS. 4 and 9, which show the embodied lock being in a locked state with the key 29 about to be inserted, or having been extracted, the bolt 24 is projecting upwardly out of and from the locking mechanism box 14, the inner cylinder 1 and operating cam 5 are disengaged from each other, and the cylinder pins 15 and 16 have levels which are not coincident with one another. By inserting the key leaves 29' from the key inserting hole 12 into the keyhole 2, the levels of the cylinder pins 15 and 16 are made coincident with one another as shown in FIGS. 5 and 10. However, since the projection 7 is engaged in the groove 22, the key 29 and inner cylinder 1 cannot as yet be turned or rotated.

Figure 6:
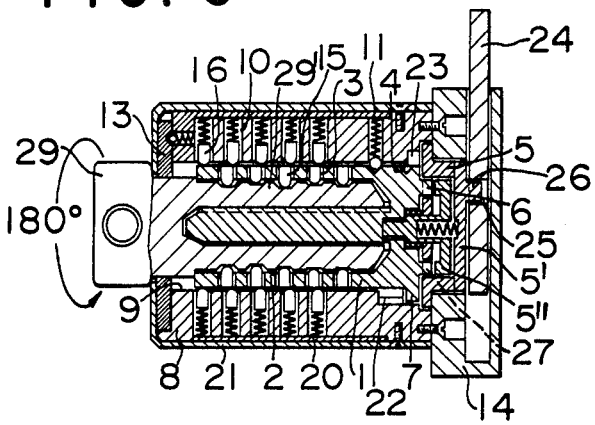
Figure 7:
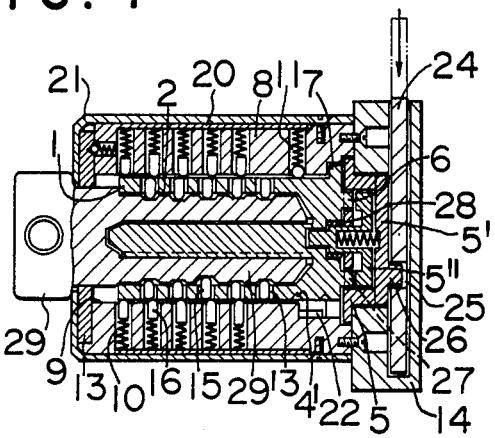

Subsequently, the key 29 is pushed in so as to move the inner cylinder 1 rearwardly which causes the projection 7 to slide out of the groove 22 and be disposed in the annular groove 23, rendering the inner cylinder 1 rotatable with the key 29, as shown in FIG. 6. At this time, the detent ball 18 has also been removed from recess 4 and is disposed in recess 4', and the projections 6 at the rear end of inner cylinder 1 become engaged with the openings 27 of cam 5 against the biasing force of spring 28. As the key 29 is turned under this condition, the inner cylinder 1, operating cam 5, and cam plate 5' rotate together, causing the projection 26 of the cam plate 5' to move the bolt 24 to its retracted position so as to unlock the lock, as shown in FIG. 7.

Figure 8:
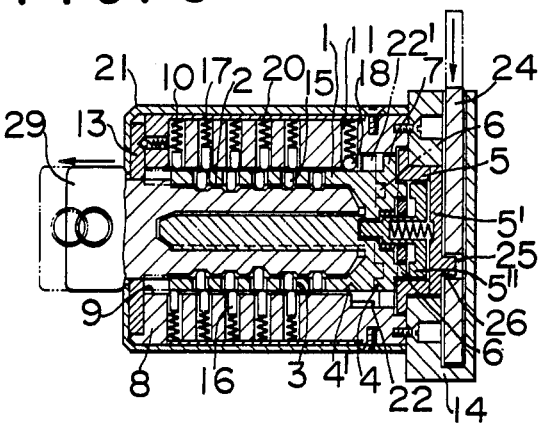
FIG. 8 is a view similar to that of FIG. 7, showing however, another embodiment of the present invention.

In this condition, the projection 7 is not in the groove 22 but is in the annular groove 23, and because the projection 7 is in contact with the rear end of the outer cylinder 8, the inner cylinder 1 will not move back to its original position, and therefore, the key 29 cannot be extracted. The embodiment may optionally be structured so as to render the key 29 extractable under this unlocked condition, for example, as shown in FIG. 8, by providing a groove 22' similar to groove 22 in the rear end of outer cylinder 8 and at a position opposite to groove 22 such that the projection 7 can move into groove 22 so as to permit the coincidence of the cylinder pins 15 and 16 to occur, whereby key 29 can be removed. The unlocking operations described above are reversely followed for the locking operations.

As explained in detail in the foregoing description by referring to an embodiment according to the present invention, the present invention provides a lock of a novel type in which an inner cylinder is provided with a keyhole comprising a plurality of slots which are radially arranged, the inner cylinder is fitted in an outer cylinder so that the inner cylinder may be slidably movable in a back-and-forth fashion therein, the rear end of the inner cylinder is provided with a cam for operating a bolt after the cam operatively engages the inner cylinder as the inner cylinder is moved rearwardly after a key is inserted into the keyhole, and the bolt may thereafter be operated by turning the key.

As a result, the key is required to have a plurality of leaves, and the key can be provided with one of many possible combinations of recesses formed in the key leaves at the same pitch, the lock therefore being provided with a high degree of security. Furthermore, a lock according to the present invention cannot be unlocked simply by inserting the key and turning the key as in the case of a conventional lock, thereby providing the lock, according to the present invention, with a still higher degree of security from the viewpoint of its use.

Obviously, many modifications and variations of the present invention are possible in light of the above teachings. It is to be understood therefore that within the scope of the appended claims, the invention may be practiced otherwise than as specifically described herein.

What is claimed as new and desired to be secured by letters patent of the United States is:

1. A locking device comprising:

an inner cylinder;

means defining a keyhole within said inner cylinder;

an outer cylinder having means defining a bore therein within which said inner cylinder is slidably disposed between first and second positions;

means disposed within said inner and outer cylinders for controlling the rotation of said inner cylinder relative to said outer cylinder comprising a plurality of radially disposed, spring-biased pins disposed within radially extending holes defined within said inner and outer cylinders;

a projection provided upon one end of said inner cylinder, and a first slot provided upon said outer cylinder;

lock bolt means for a locking or unlocking an apparatus with which said locking device is operatively associated;

cam means operatively connected to said lock bolt means for actuating said lock bolt means and operatively engageable with said inner cylinder;

means interposed between said cam means and said inner cylinder for normally disengaging said cam means and said inner cylinder by disposing said inner cylinder at said first position;

key means for moving said control means to operative positions so as to permit rotation of said inner cylinder relative to said outer cylinder and for moving said inner cylinder to said second position so as to engage said inner cylinder with said cam means whereby rotation of said inner cylinder relative to said outer cylinder rotates said cam means actuates said lock bolt means and groove means operatively engageable with said projection, when said inner cylinder is in said second position and rotated relative to said outer cylinder for retaining said inner cylinder in said second position whereby said key means cannot be withdrawn from said locking device when said inner cylinder is in a rotated position relative to said outer cylinder and wherein said cam means comprises an operating cam, a cam plate, and a cam member interconnecting said operating cam and said cam plate such that said inner cylinder, said operating cam and said cam plate are rotatable together during said rotation of said inner cylinder relative to said outer cylinder so as to rotate said cam means and actuate said lock bolt means.

2. A locking device as set forth in claim 1, further comprising:

a second projection provided upon said one end of said inner cylinder and, wherein said cam means is provided with an opening such that said second projection is operatively engaged with said opening of said cam means when said inner cylinder is in said second position.

3. A locking device as set forth in claim 1, wherein:

said lock bolt means is provided with a guide aperture; and said cam means includes a projection parallel to the longitudinal axis of said cam member such that said projection is operatively engaged with said guide aperture whereby said lock bolt means is displaced during said rotation of said inner cylinder relative to said outer cylinder.

* * * * *

UNITED STATES PATENT AND TRADEMARK OFFICE

CERTIFICATE OF CORRECTION

PATENT NO. : 4,148,201

DATED : April 10, 1979

INVENTOR(S) : YASUO MIYAMAE

It is certified that error appears in the above-identified patent and that said Letters Patent are hereby corrected as shown below:

Please insert the following priority information:

[30] -- November 22, 1975 Japan ... 50-140591 -- as it was omitted from the Letters Patent.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*